US008882235B2

(12) United States Patent
Nukui et al.

(10) Patent No.: US 8,882,235 B2
(45) Date of Patent: Nov. 11, 2014

(54) IMAGE RECORDING APPARATUSES

(71) Applicants: Kosuke Nukui, Nagoya (JP); Yoichiro Shimizu, Kasugai (JP)

(72) Inventors: Kosuke Nukui, Nagoya (JP); Yoichiro Shimizu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/852,891

(22) Filed: Mar. 28, 2013

(65) Prior Publication Data

US 2013/0293622 A1 Nov. 7, 2013

(30) Foreign Application Priority Data

May 7, 2012 (JP) ..... 2012-105792

(51) Int. Cl.

| | |
|---|---|
| ***B41J 29/393*** | (2006.01) |
| ***B41J 2/01*** | (2006.01) |
| ***B41J 29/38*** | (2006.01) |
| ***B41J 2/165*** | (2006.01) |
| ***B41J 11/00*** | (2006.01) |
| ***B41J 2/21*** | (2006.01) |
| ***B41J 2/155*** | (2006.01) |

(52) U.S. Cl.

CPC ..... *B41J 29/38* (2013.01); *B41J 2/16585* (2013.01); *B41J 11/006* (2013.01); *B41J 2002/16555* (2013.01); *B41J 2/2114* (2013.01); *B41J 2/155* (2013.01); *B41J 2002/16573* (2013.01)

USPC ..... 347/19; 347/104

(58) Field of Classification Search

CPC ..... B41J 29/393; B41J 2/0451; B41J 2/0458; B41J 2/17546; B41J 2/2135; B41J 11/0095; B41J 29/38; B41J 11/42; B41J 3/60

USPC ..... 347/19, 16, 4, 9, 33

See application file for complete search history.

(56) References Cited

U.S. PATENT DOCUMENTS

| | | | | |
|---|---|---|---|---|
| 8,104,868 | B2 | 1/2012 | Taira | |
| 2009/0289985 | A1 | 11/2009 | Sumida et al. | |
| 2012/0127231 | A1* | 5/2012 | Nukui | 347/19 |
| 2013/0076826 | A1* | 3/2013 | Nukui | 347/16 |

FOREIGN PATENT DOCUMENTS

| | | | |
|---|---|---|---|
| JP | 2003-165230 | A | 6/2003 |
| JP | 2009-279777 | A | 12/2009 |
| JP | 2011-178053 | A | 9/2011 |

* cited by examiner

*Primary Examiner* — Lisa M Solomon
(74) *Attorney, Agent, or Firm* — Baker Botts L.L.P.

(57) ABSTRACT

An image recording apparatus includes a liquid applying mechanism that applies a first liquid onto a recording medium, a liquid discharge head that discharges a second liquid onto the recording medium, a wiper that wipes a liquid discharge surface of the liquid discharge head, and a processor. The processor counts a number of jams of the recording medium and a number of passages of the recording medium through the liquid discharge head. The processor increments the number of jams when the number of passages is equal to or greater than a first threshold value. The image recording apparatus performs a head recovery operation when a jam of a recording medium occurs and when the number of jams is incremented.

11 Claims, 14 Drawing Sheets

NORMAL PURGING PROCEDURE

JAM PURGING ROCEDURE

IMAGE RECORDING APPARATUSES

CROSS-REFERENCE TO RELATED APPLICATION

This application claims priority from Japanese Patent Application No. 2012-105792 filed on May 7, 2012, which are incorporated herein by reference.

BACKGROUND OF THE INVENTION

1. Field of the Invention

The present invention relates to an image recording apparatus in which a liquid is discharged from a discharge port onto a recording medium.

2. Description of Related Art

In known printers which have been developed to reduce ink bleed of dots formed on a sheet, a pretreatment liquid is applied to target areas in advance of application of ink to agglomerate or precipitate pigments contained in the ink.

In such known printers, when an image forming region is jammed with sheets, the pretreatment liquid applied onto the sheets increasingly adheres to a side surface of an ink discharging head, and the adhered pretreatment liquid transfers to a discharge surface and contacts the ink. In addition, even when sheet jams did not occur, a surface of a sheet onto which the pretreatment liquid has been applied contacts the discharge surface, which brings the pretreatment liquid into contact with ink on the discharge surface. In such a case, agglomerated or precipitated pigments of the ink partially or entirely close the discharge port, which significantly reduces ink discharge properties. Similarly in printers having a plurality of heads for discharging different color inks, an ink applied onto a sheet in advance adheres to a side surface or discharge surface of a head for discharging a different color ink causing a reduction in the quality of images due to color mixture.

SUMMARY OF THE INVENTION

It is an object of the present invention to provide an image recording apparatus which is configured to perform a head recovery operation.

According to an embodiment of the present invention, an image recording apparatus comprising: a liquid applying mechanism configured to apply a first liquid onto a recording medium; a liquid discharge head comprising a liquid discharge surface and configured to discharge a second liquid from a liquid discharge port formed in the liquid discharge surface onto the recording medium, wherein the liquid discharge head is disposed downstream from the liquid applying mechanism in a transport direction of the recording medium; a wiper configured to wipe the liquid discharge surface of the liquid discharge head: a recording medium sensor disposed downstream from the liquid discharged head in the transport direction and configured to detect a presence of the recording medium: a processor; and a computer readable medium storing computer readable instructions. The computer readable instructions, when executed by the processor, cause the image recording apparatus to perform: determining a jam of a recording medium onto which the first liquid has been applied by the liquid applying mechanism based on a detection of the recording medium sensor; counting a number of jams determined; determining a passage of a recording medium through a region facing the liquid discharge head; counting a number of passages determined; incrementing the number of jams when the number of passages is equal to or greater than a first threshold value; and performing a head recovery operation in which the liquid discharge head discharges the second liquid through the liquid discharge port and the wiper wipes the discharge surface when a jam of a recording medium is determined and when the number of jams is incremented.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Figure 1:
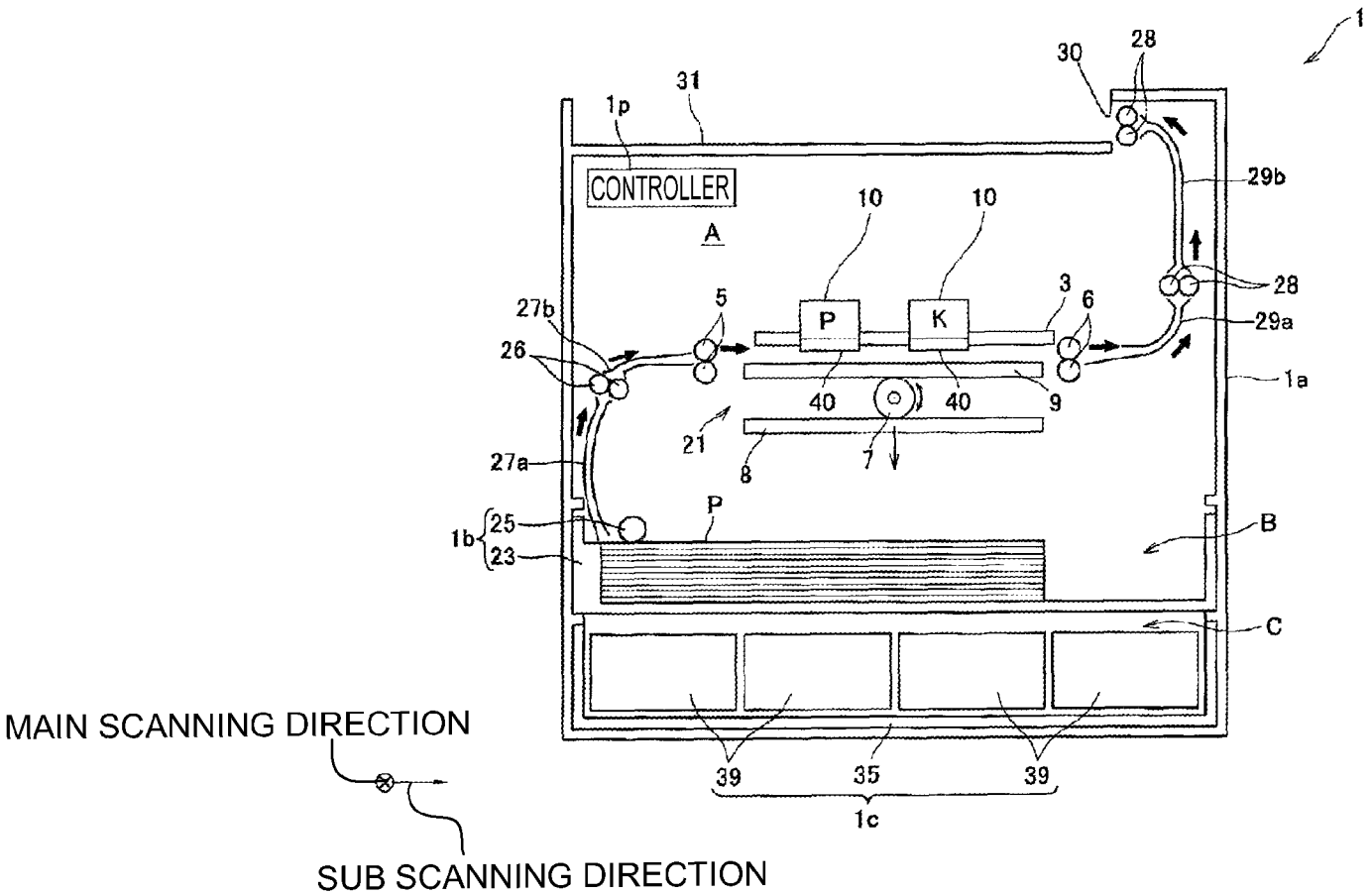
FIG. 1 is a schematic side view illustrating the internal configuration of an ink jet printer according to an embodiment of the present invention.

Example embodiments are described in detail herein with reference to the accompanying drawings, like reference numerals being used for like corresponding parts in the various drawings.

Referring to FIG. 1, the printer 1 may include a rectangular housing 1*a*. A sheet discharge portion 31 may be provided at the top of the housing 1*a*. The inner space of the housing 1*a* may be divided into spaces A, B, and C in sequence from the top. A sheet transport path may be provided in the space A and B so as to be in communication with the sheet discharge portion 31. In parallel with the sheet transport path, multiple jam detection sensors 81 may be provided, e.g., FIG. 9. The space C may hold cartridges 39, from which liquids may be supplied to heads 10.

Figure 5:
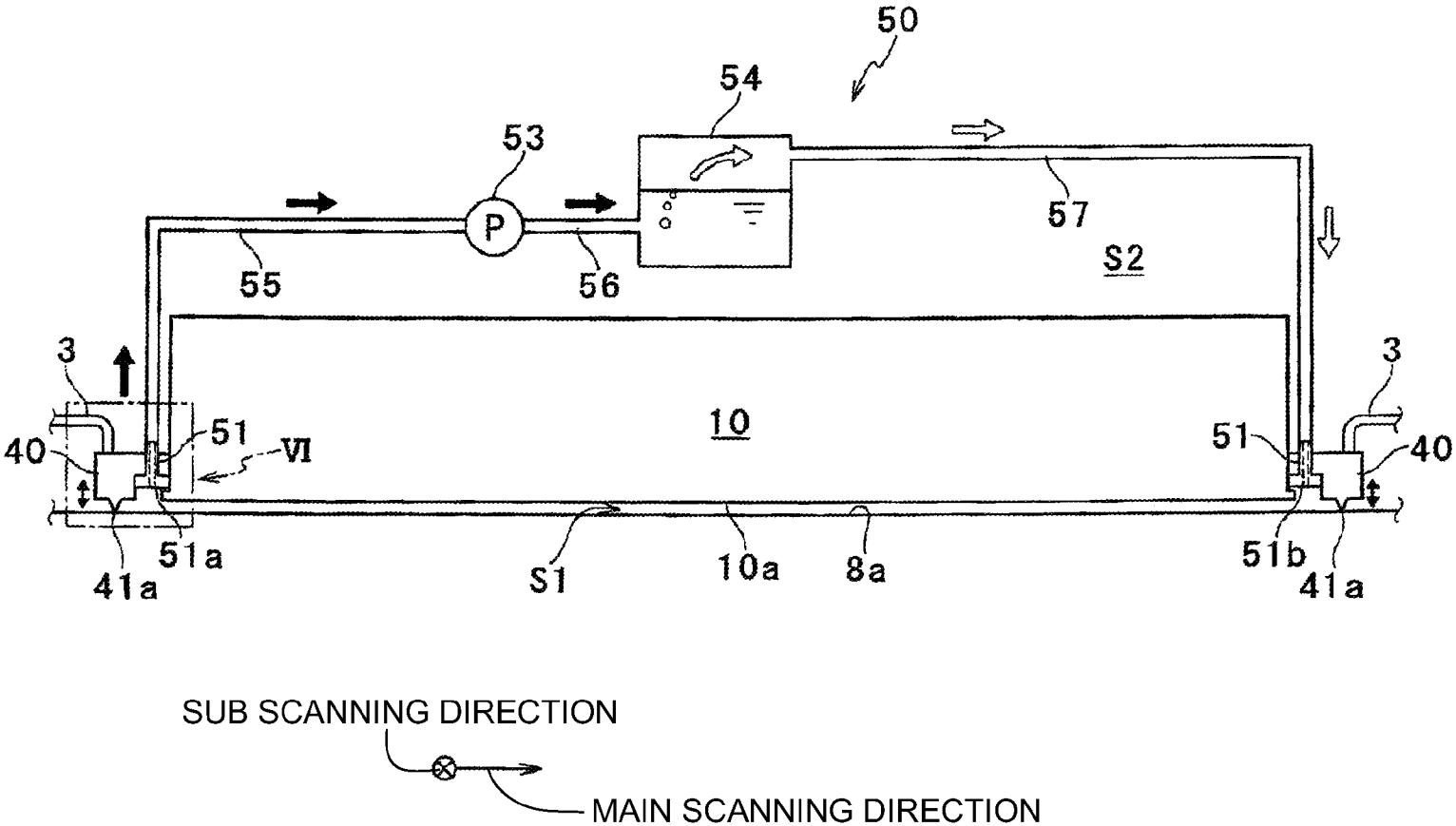
FIG. 5 is a schematic view illustrating a head holder and a humidifying mechanism according to an embodiment of the present invention.
Figure 8A:
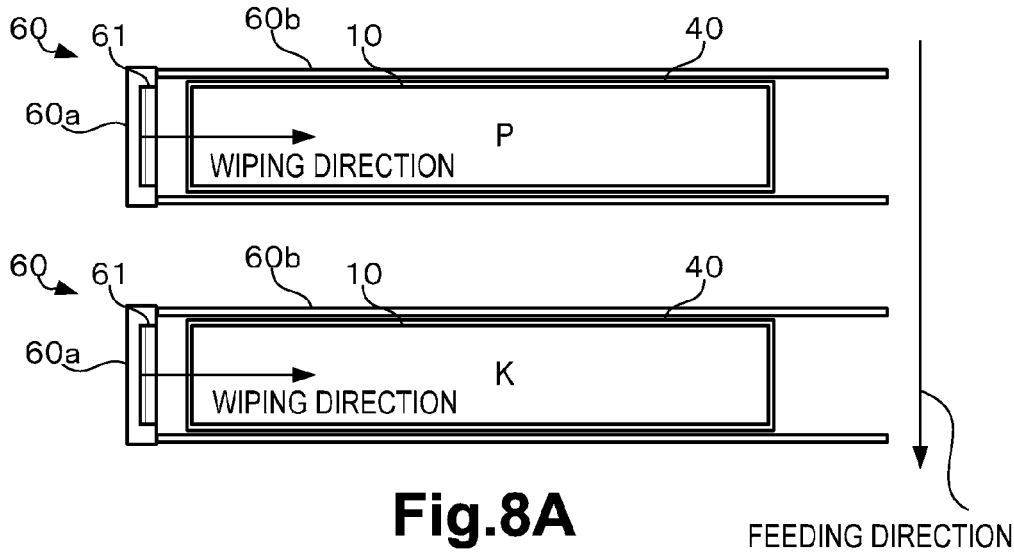
FIG. 8A is a schematic view illustrating a wiping mechanism according to an embodiment of the present invention.
Figure 8B:
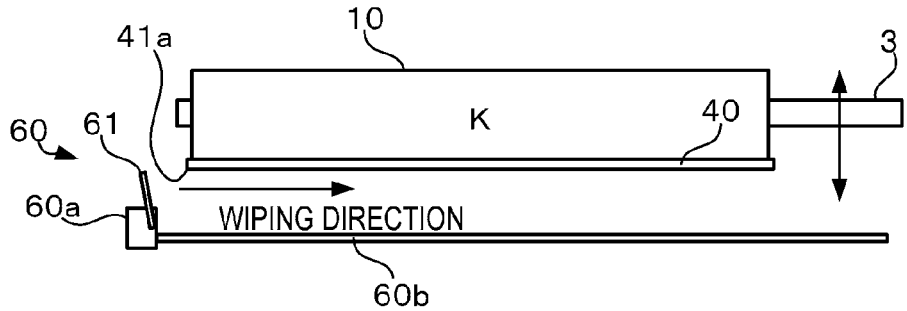
FIG. 8B is another schematic view illustrating a wiping mechanism according to an embodiment of the present invention.
Figure 8C:
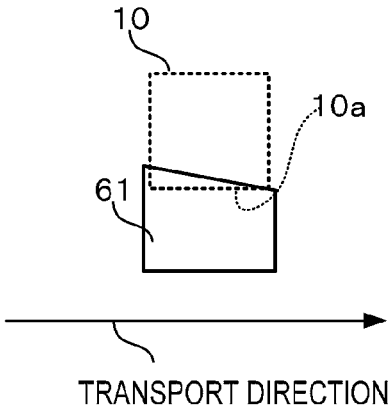
FIG. 8C is still another schematic view illustrating a wiping mechanism according to an embodiment of the present invention.

The space A may hold the two heads 10, a transport unit 21 for transporting sheet P, a guide unit for guiding the sheet P, a humidifying mechanism 50, which may perform a humidifying process, e.g., FIG. 5, and a wiper moving mechanism 60, e.g., FIGS. 8A-8C. A controller 1*p* may be provided at an upper portion of the space A to control the operation of various components of the printer 1.

Figure 9:
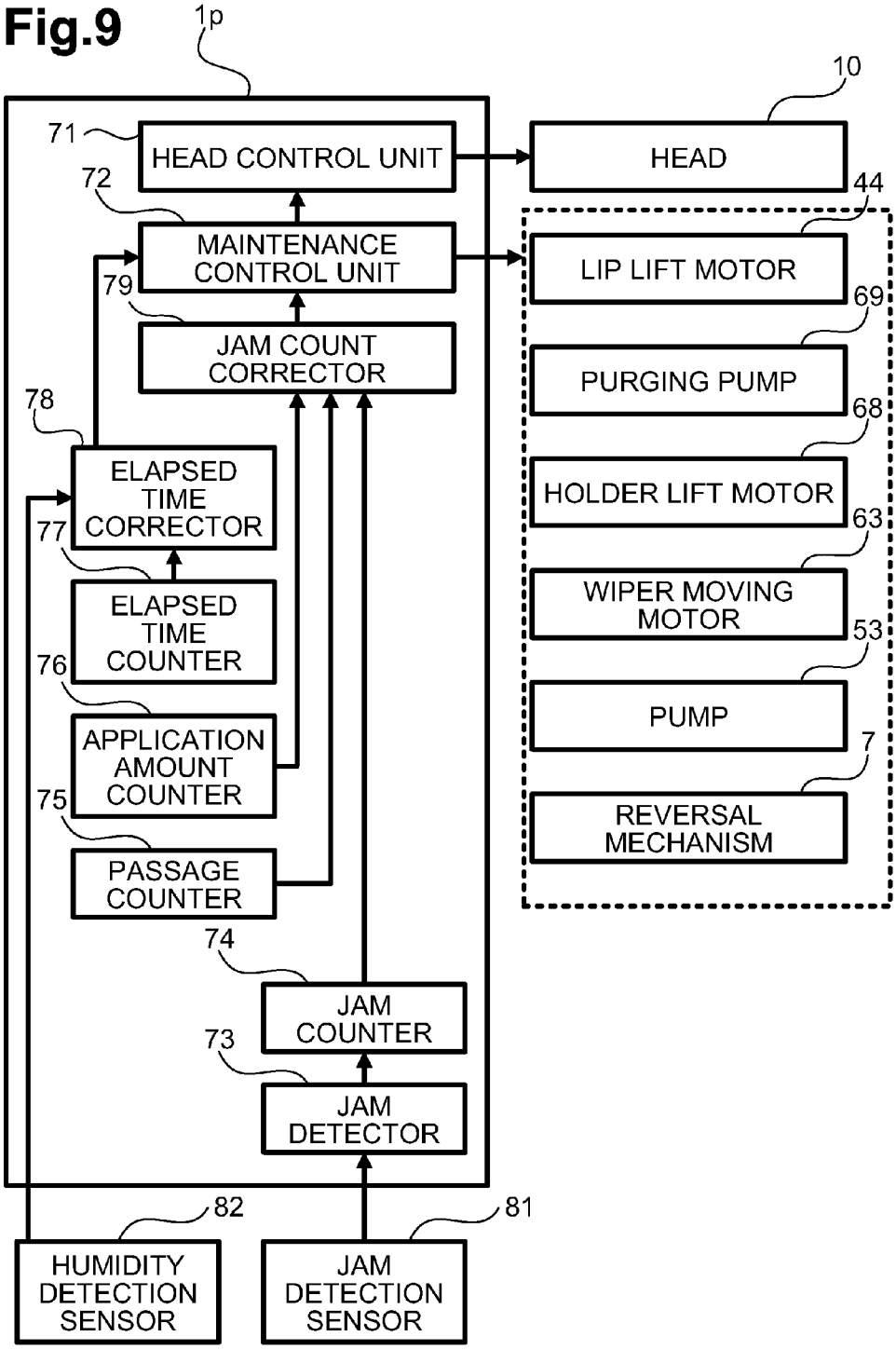
FIG. 9 is a functional block diagram illustrating a controller of a printer according to an embodiment of the present invention.

Based on the image dada sent from an external device, the controller 1*p* may control a transport operation of the sheet P by the components of the printer 1, an ink discharge operation in conjunction with the transport of the sheet P, and a maintenance operation for recovering and maintaining ink discharge function. The maintenance operation may include a flushing process, a purging process, a wiping process, and a humidifying process. The flushing process may include a discharge of ink from all or part of discharge ports 14*a* formed in discharge surfaces 10*a* of the heads 10 when actuators corresponding to the appropriate discharge ports 14*a* are driven. Ink droplets may be discharged from the discharge ports 14*a* in a predetermined number based on flushing data, e.g., data different from image data. The purging process may include a discharge of ink from all of the discharge ports 14*a* when a purging pump 69, e.g., FIG. 9, is driven. A pressure generated by the purging pump 69 may cause a predetermined amount of ink to be discharged from the discharge ports 14*a*. The wiping process may include cleaning of the discharge surfaces 10*a*, which may be wiped with a wiper 61. These processes may be performed after discharge of each ink. The humidifying process may include a supply of moisture to the discharge ports 14*a*. Humidified air may be supplied to a discharge space S1, e.g., FIG. 5, facing each discharge surface 100*a*.

The transport unit 21 may comprise a platen 9 and two pairs of transport nip rollers 5 and 6. The two pairs of transport nip rollers 5 and 6 may be disposed at the two sides in a transport direction, respectively, with the platen 9 disposed therebetween. Each pair of the transport nip roller 5 and 6 may comprise two rollers and may transport the sheet P in the transport direction while the sheet P is vertically pinched. The pair of transport nip rollers 5 may transport the sheet P onto the upper surface of the platen 9. The pair of transport nip rollers 6 may transport the sheet P from the upper surface of the platen 9 to the sheet discharge portion 31.

The platen 9 may be disposed so as to face the discharge surfaces 10*a* at a predetermined distance during printing and may constitute a portion of the paper transport path. Referring to FIG. 1, the platen 9 may be a component of an opposite member-switching mechanism including a reversal mechanism 7 and a glass table 8. In the maintenance operation, the reversal mechanism 7 may be driven, so that the glass table 8 may be disposed so as to face the discharge surfaces 10*a* in place of the platen 9. The opposite member-switching mechanism may move up and down, and the opposite member may change position in which the opposite member-switching mechanism may move down.

Each of the heads 10 may be a line scan head with a substantially rectangular shape extending in a main scanning direction. The lower surface of each head 10 may function as the discharge surface 10*a*, e.g., liquid discharge surface, having the multiple discharge ports 14*a*, e.g., FIGS. 3 and 4. A head 10(P), e.g., a liquid supplying mechanism, may be disposed on the upstream side of the paper transfer path, and a head 10(K), e.g., a liquid discharge head, may be disposed on the downstream side thereof. In a printing process, the head 10(P) may discharge droplets of a pre-coating liquid, e.g., first liquid, to an image forming region of the sheet P, and then the head 10(K) may discharge ink droplets, e.g., second liquid, onto the pre-coating liquid applied to the image forming region.

The pre-coating liquid may comprise cationic polymers and multivalent metal salts, e.g., magnesium salt, and may react with colorants of ink to generate insoluble or poorly soluble metal complexes. The pre-coating liquid may react with a pigment ink to agglomerate a pigment. The pre-coating liquid may react with a dye ink to precipitate a dye. Hence, ink bleed may be prevented. In addition, ink may be less likely to permeate the sheet P, which may increase the fixability of the ink to a surface of the sheet P. The quality of images can be thus enhanced.

Each of the two heads 10 may be held by the housing 1*a* via a head holder 3. Each discharge surface 10*a* may face the platen 9 or the glass table 8 with a gap interposed therebetween at a predetermined distance. The head holder 3 may comprise an annular cap 40 and a pair of joints 51 for each head 10. The term "sub-scanning direction" herein may refer to a direction parallel to a direction in which the sheet P is transported by the transport unit 21, and the term "main scanning direction" herein may refer to a direction parallel to a horizontal plane and orthogonal to the sub-scanning direction.

The head holder 3 may be moved up and down by a holder lift mechanism having a holder lift motor 68, e.g., FIG. 9, as a source of power. The head holder 3 may shift among three positions, e.g., a printing position, a wiping position, and a safe position, respectively, in sequence from the bottom, e.g., FIGS. 10A-10C. At the printing position, the heads 10 may discharge liquid droplets to the sheet P. At the wiping position, each discharge surface 10*a* may be wiped by the wiper 61. At the safe position, the wiper 61 may not contact each discharge surface 10*a*.

The guide unit may be provided in parallel with the paper transfer path and may have two sections with the transport unit 21 interposed therebetween. An upstream-side guide section may comprise two guides 27*a* and 27*b* and a pair of feed rollers 26. The upstream-side guide section may connect a sheet feed unit 1*b* to the transport unit 21. A downstream-side guide section may comprise two guides 29*a* and 29*b* and two pairs of feed rollers 28. The downstream-side guide section may connect the transport unit 21 to the sheet discharge portion 31.

The space B may hold the sheet feed unit 1*b*. The sheet feed unit 1*b* may include a tray 23 and a roller 25, and the tray 23 may be detachable from the housing 1*a*. The tray 23 may have a box shape and may open upward. The tray 23 may accommodate the sheet P of various sizes. The roller 25 may feed the topmost sheet P in the tray 23 and transport the sheet P to the upstream-side guide section.

The sheet transport path may be provided in the spaces A and B so as to extend from the sheet feed unit 1*b* to the sheet discharge portion 31 through the transport unit 21. In response to a printing command input from an external device, the controller 1*p* may drive a sheet feed motor for the roller 25, feed motors for the feed rollers of the guide sections, and a transport motor. The sheet P fed from the tray 23 may be transported to the transport unit 21 by the feed rollers 26. The pre-coating liquid and ink may be discharged in sequence while the sheet P passes immediately below the heads 10 in the sub-scanning direction, so that images may be formed on the sheet P. Then, the sheet P may be transported upward by the two pairs of feed rollers 28. The sheet P may subsequently be discharged from an opening 30 formed at the top of the housing 1*a* onto the sheet discharge portion 31.

The space C may hold an ink unit 1*c* provided so as to be detachable from the housing 1*a*. The ink unit 1*c* may include a cartridge tray 35, two cartridges 39 disposed alongside in the cartridge tray 35, and a water tank 54, e.g., FIG. 5. The pre-coating liquid and ink may be supplied from the cartridges 39 to the heads 10 via tubes, respectively.

Figure 2:
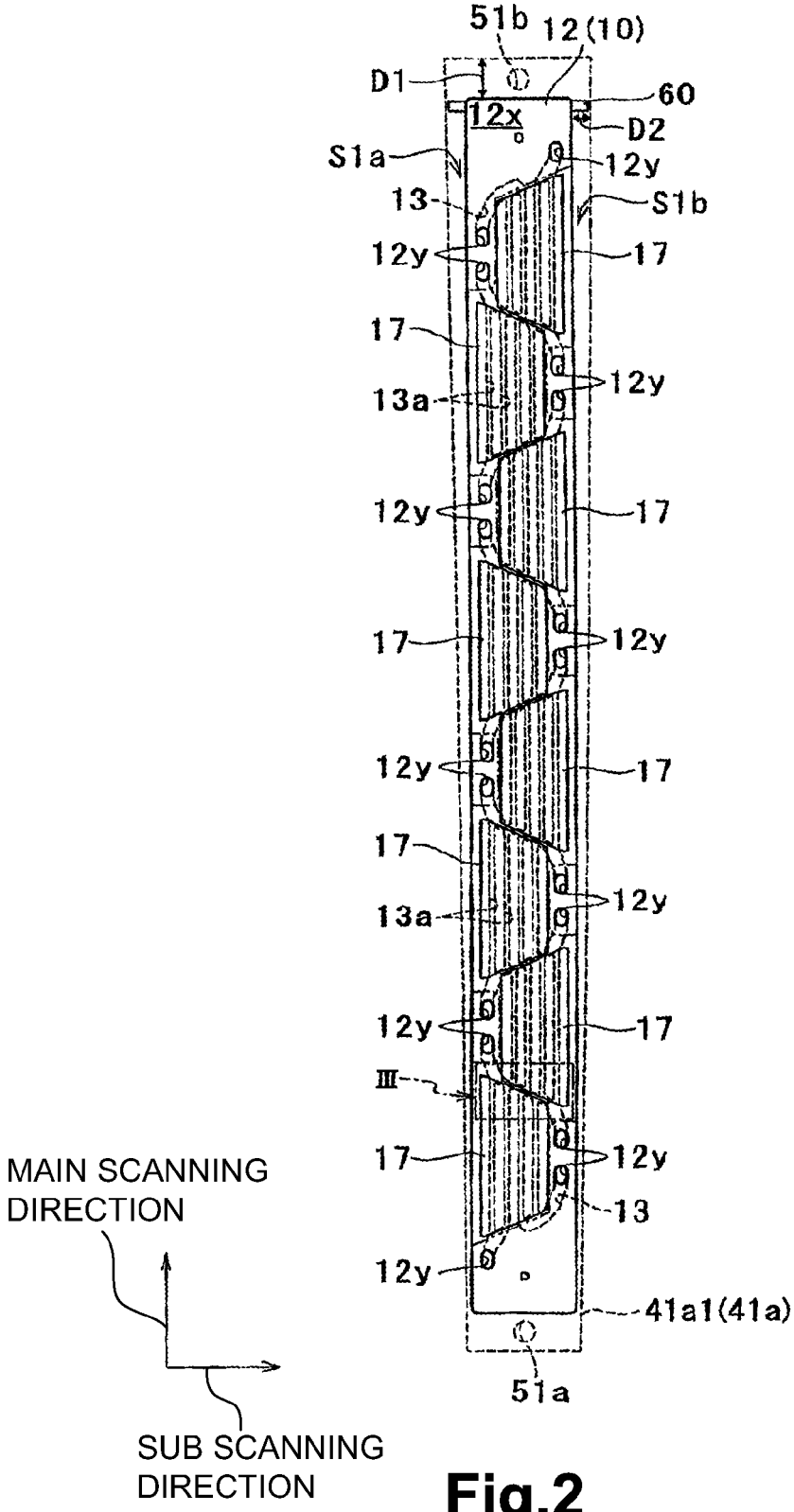
FIG. 2 is a plan view illustrating a channel unit and actuator units of an ink jet head according to an embodiment of the present invention.
Figure 3:
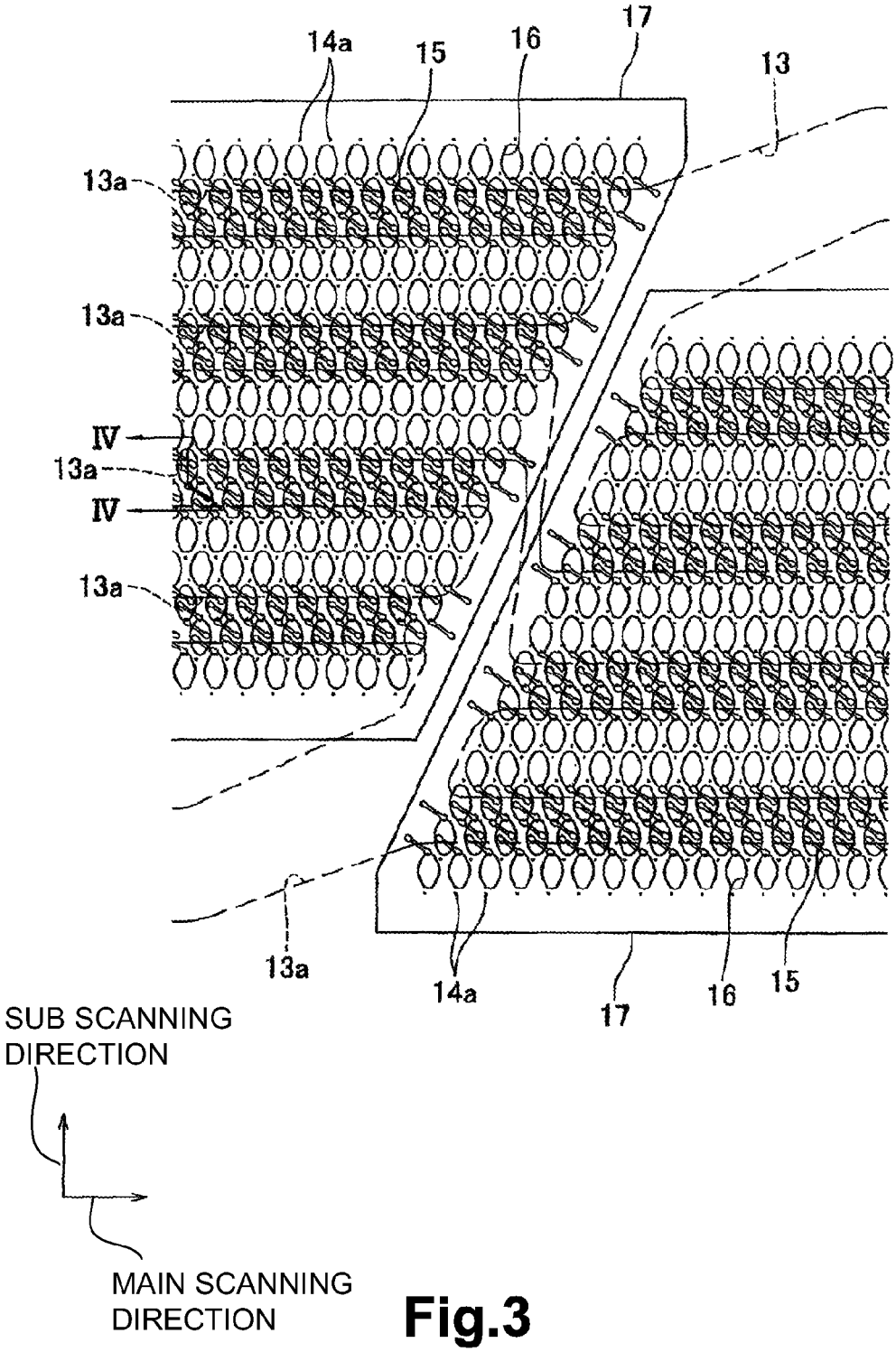
FIG. 3 is an enlarged view illustrating a region III indicated by a dashed line in FIG. 2.
Figure 4:
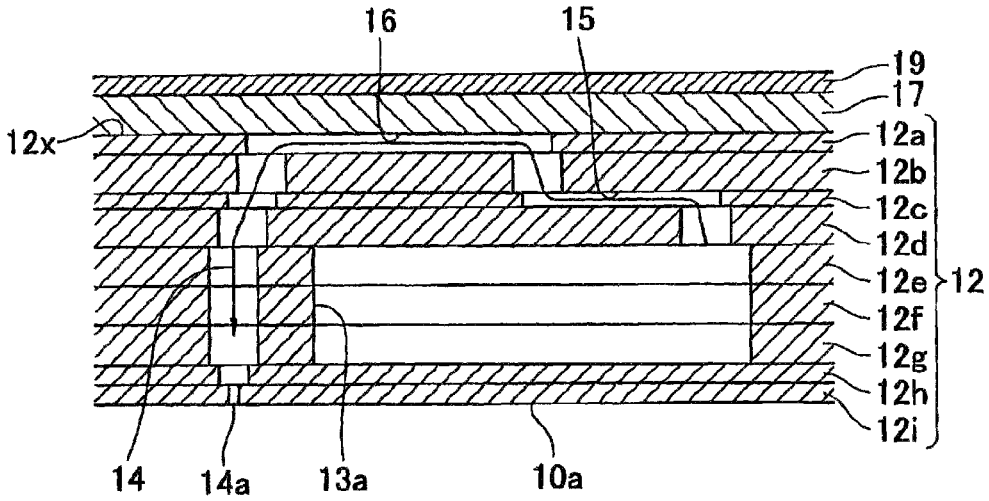
FIG. 4 is a cross-sectional view illustrating the region III taken along the line IV-IV in FIG. 3.

Referring to FIGS. 2 to 4, each head 10 may have a layered structure including a channel unit 12, on which the actuator units 17 may be mounted, a reservoir unit 11, and a circuit board each provided in sequence from bottom. The eight actuator units 17 may be fixed to the upper surface of the channel unit 12. A flexible printed circuit (FPC), to which a driver integrated circuit (IC) may be mounted, may connect the actuator units 17 to the circuit board.

The channel unit 12 may have a layered structure of nine metallic plates 12*a* to 12*i* provided in sequence, as illustrated in FIG. 4, and may have a rectangular shape in plan view. The channel unit 12 may have internal manifold channels 13 extending from openings 12*y* formed in an upper surface 12*x* of the channel unit 12, sub-manifold channels 13*a* extending from the manifold channels 13 into branches, and individual ink channels 14 extending from the exits of the sub-manifold channels 13*a* to the discharge ports 14*a* via pressure chambers 16. The individual ink channels 14 may be provided for corresponding discharge ports 14*a* and may include the apertures 15, e.g., narrow portions for adjusting resistance in the channels. The pressure chambers 16 may be formed in the upper surface 12*x* in regions to which the actuator units 17 are attached. The discharge ports 14*a* may be formed in the discharge surface 10*a* in a region facing the attachment region in a matrix pattern.

The actuator units 17 may be disposed in a staggered pattern of two rows so as not to overlap the openings 12*y*. The actuator units 17 may have unimorph-type actuators for the corresponding discharge ports 14*a* so as to cover the corresponding pressure chambers 16. Each unimorph-type actuator may include multiple stacked piezoelectric layers, an electrode provided on the outermost surface of the actuator and facing the pressure chamber 16, and a common electrode with the outermost layer interposed between the electrode and the common electrode.

The reservoir unit 11 may have an internal ink channel including a reservoir. The reservoir temporarily may hold ink supplied from the cartridges 39. The reservoir unit 11 may have an uneven lower surface with a protrusion and a hollow. In the protrusion, one end of the ink channel may open and be in communication with the opening 12*y* of the channel unit 12. The hollow may form a gap with the upper surface 12*x*. The actuator units 17 may be provided in this gap such that a small space may be formed between the hollow and each actuator unit 17.

In the circuit board, a variety of driving signals sent from the controller 1*p* may be processed and then output to the actuators via the driver IC. The output of the driving signals may enable the actuators to change the volumes of the corresponding pressure chambers 16, so that liquid droplets may be discharged from the corresponding discharge ports 14*a*.

Figure 6:
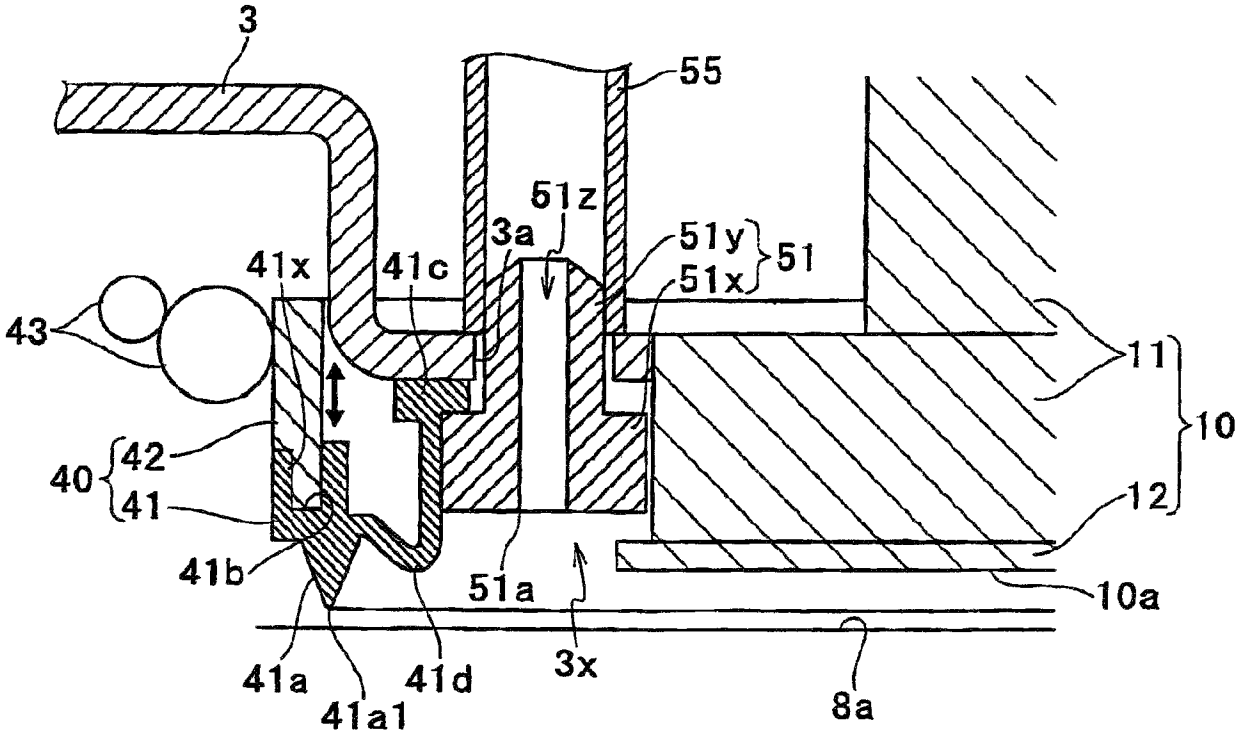
FIG. 6 is a cross-sectional view illustrating a region VI indicated by a dashed line in FIG. 5.

Referring to FIGS. 2, 5, and 6, the head holder 3 may be a frame formed from a metal and may hold the discharge surface 10*a* at a predetermined position relative to the opposite members, e.g., glass table 8 and platen 9. Components which serve for the maintenance operation, such as part of the humidifying mechanism 50 and the cap 40, also may be held by the head holder 3 for each head 10. Such part of the humidifying mechanism 50 may be a supply port and a discharge port, e.g., a pair of joints 51, for humidified air. The cap 40 may be an annular member which may cover the periphery of the discharge surface 10*a*.

The pair of joints 51 may be closely provided at the two ends of the head 10 in the main scanning direction. In the humidifying process, as illustrated in FIG. 5, the right joint 51 may supply humidified air to a discharge space S1. The lower surface of this joint 51 may have an opening 51*b* which functions as the supply port of the humidified air. The left joint 51 may retrieve air from the discharge space S1. The lower surface of this joint 51 may have an opening 51*a* which may function as a discharge port. Each joint 51 may have a base portion 51*x* and a cylindrical portion 51*y* as illustrated in FIG. 6. A hollow space 51*z* may be provided so as to vertically penetrate the base portion 51*x* and the cylindrical portion 51*y*. The cylindrical portion 51*y* may be inserted into a through-hole 3*a* of the head holder 3 and may have a tapered end connected to a tube 55. A small gap may be provided between the cylindrical portion 51*y* and the through-hole 3*a*, and such a gap may be filled with a sealing material.

Each cap 40 may include an elastic body 41 and a movable portion 42 which may move up and down. The elastic body 41 may be formed from an elastic material, such as rubber, and may include four parts, e.g., base part 41*x*, protruding part 41*a*, fixing part 41*c*, and connecting part 41*d*, as illustrated in FIG. 6.

The fixing part 41*c* may have a T-shaped cross-sectional structure. The flat upper surface of the fixing part 41*c* may be bonded to the head holder 3 to surround the entire head 10, e.g., discharge surface 10*a*. The fixing part 41*c* is partially pinched by the head holder 3 and the joint 51, e.g., base portion 51*x*, in the vicinity of the through-hole 3*a*. The connecting part 41*d* may connect the fixing part 41*c* positioned at the inner side to the base part 41*x* positioned at the outer side. The connecting part 41*d* may extend therebetween while curving. The curve of the connecting part 41*d* may enable the base part 41*x* to be moved up and down by the movable portion 42. The protruding part (lip) 41*a* may project from the lower surface of the base part 41*x* in a tapered manner and may have a triangular cross-sectional surface. The base part 41*x* may have a recess 41*b* formed in the upper surface thereof, and the recess 41*b* may couple to the lower end of the movable portion 42.

The movable portion 42 may have an annular metallic component and may be moved in a vertical direction relative to the head holder 3. The movable portion 42 may connected to a lip lift motor 44, e.g., FIG. 9, through multiple gears 43. When the lip lift motor 44 is driven by the controller 1*p*, the movable portion 42 may move up together with the base part 41*x*. The vertical movement of the movable portion 42 may enable the protruding part 41*a* to selectively shift between a contact position, e.g., FIG. 5, at which a tip 41*a*1 of the protruding part 41*a* may contact the glass table 8, e.g., surface

8*a*, and a separation position, e.g., FIG. 6, at which the tip 41*a*1 may be away from the surface 8*a*. When the heads 10 are at a printing position, the tip 41*a*1 may contact the surface 8*a* at the contact position, which may isolate the discharge space S1 from an outer space S2. In this case, the discharge space S1 may be in a sealed state. At the separation position, the discharge space S1 may be in communication with the outer space S2 in an unsealed state.

Figure 7:
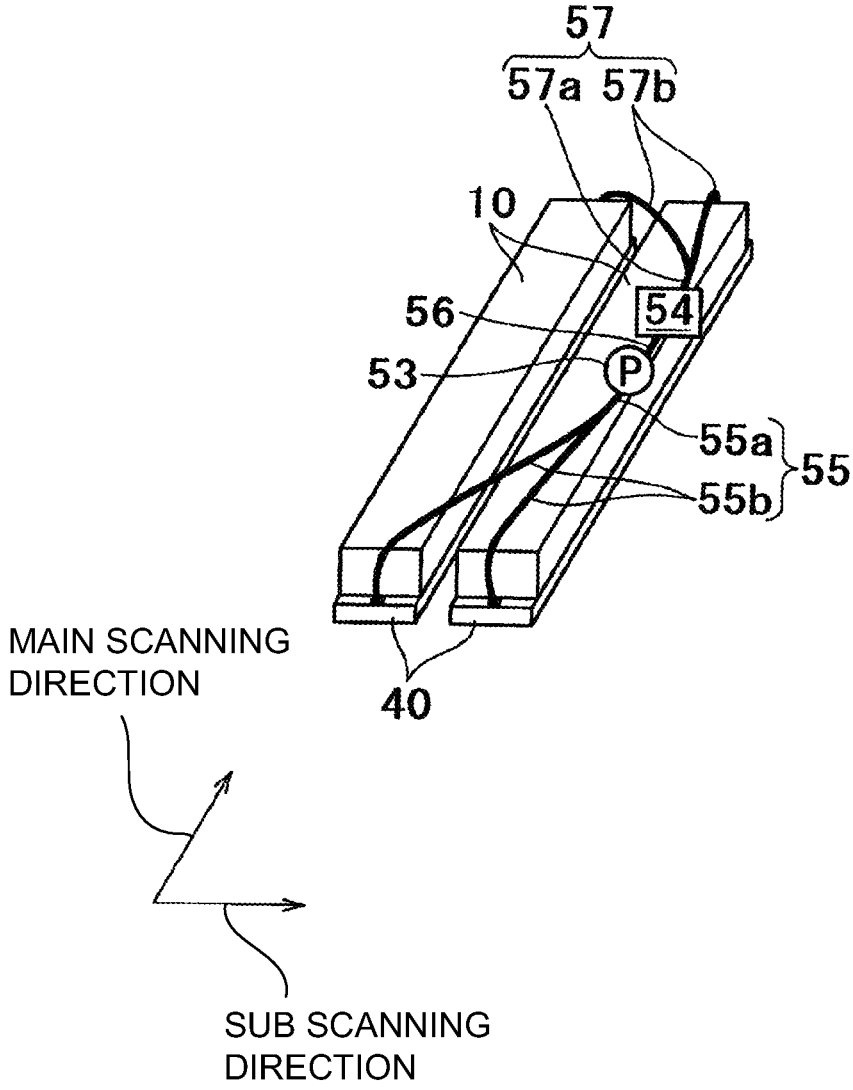
FIG. 7 is a schematic view illustrating connection of heads to a humidifying mechanism according to an embodiment of the present invention.

Referring to FIG. 5, the humidifying mechanism 50 may include the joints 51, tubes 55, 56, and 57, a pump 53, and a tank 54. Each head 10 may be provided with the two joints 51. The pump 53 and the tank 54 may be common to each head 10, as illustrated in FIG. 7. The tubes 55 and 57 may have main portions 55*a* and 57*a* common to each head 10 and branched portions 55*b* and 57*b* separated from the main portions 55*a* and 57*a* into two tracks so as to extend to the joints 51, respectively.

One end of the tube 55, e.g., end of the branched portion 55*b*, may be attached to one of the joints 51, e.g., left side in FIG. 5, and the other end, e.g., end of the main portion 55*a* opposite to the branched portion 55*b*, may be connected to the pump 53. The tube 56 may connect the pump 53 to the tank 54. One end of the tube 57, e.g., end of the branched portion 57*b*, may be attached to the other one of the joints 51, e.g., right side in FIG. 5, and the other end, e.g., end of the main portion 57*a* opposite to the branched portion 57*b*, may be connected to the tank 54.

The tank 54 may hold water in its lower space and humidified air in its upper space. The tube 56 may be connected to the tank 54 at a level lower than the surface of water held in the tank 54, e.g., lower space, and the tube 57 may be connected to the tank 54 at a level higher than the surface of water held in the tank 54, e.g., upper space. The tube 56 may have a check valve which may enable air to flow only in a direction indicated by arrows as shown in FIG. 5.

Referring to FIGS. 8A and 8B, the wiper moving mechanism 60 may be provided for each head 10. Each wiper moving mechanism 60 may have a wiper 61, a wiper holder 60*a*, a pair of guides 60*b*, and a wiper moving motor 63, e.g., FIG. 9. The wiper holder 60*a* may hold the wiper 61 and may move along the guides 60*b*. The guides 60*b* may pinch the head 10 in the sub-scanning direction and may extend in the main scanning direction. The wiper 61 may be formed from an elastic material so as to have a planar shape and be disposed such that its longitudinal direction may aligned with the sub-scanning direction. The wiper moving motor 63 may be driven to reciprocate the wiper holder 60*a* along the guides 60*b*. When the wiping process is not performed, the wiper 61 may be disposed at a stand-by position. The stand-by position may be in the vicinity of the left side of each head 10 in FIGS. 8A and 8B.

As illustrated in FIG. 8C, the upper surface of the wiper 61 may be tilted such that an end on the upstream side in the sheet transport direction may have a greater height in a direction orthogonal to the discharge surface 10*a*. In the wiping process, the pressing force of the wiper 61 to the discharge surface 10*a* may greater on the upstream side in the sheet transport direction relative to the downstream side, which may be effective in the removal of agglomerate derived from the ink and the pre-coating liquid.

The controller 1*p* may include a central processing unit (CPU), e.g., a processor, a nonvolatile memory, e.g., a computer readable medium, which may store a program executed by the CPU and data used in the program in a rewritable manner, and a random access memory (RAM) which may temporarily store data at the execution of the program. In each functional section of the controller 1*p*, such hardware and the software stored in the nonvolatile memory may be in cooperation with each other. Referring to FIG. 9, the controller 1*p* may include a head control unit 71, a maintenance control unit 72, a jam detector 73, a jam counter 74, a passage counter 75, an application amount counter 76, an elapsed time counter 77, an elapsed time corrector 78, and a jam count corrector 79.

The actuator units 17 may be controlled by the head control unit 71 in an image forming process and the flushing process. In the image forming process, droplets of each liquid, e.g., ink droplets and pre-coating liquid droplets, may be discharged based on image data. The discharge of liquid droplets may be performed in conjunction with transport of the sheet P at a predetermined moment determined by signals output from a sheet sensor (tip detection signal). In the flushing process, droplets of each liquid may be discharged based on flushing data.

The jam detector 73 may receive detection signals output from the multiple jam detection sensors 81, e.g., a recording medium sensor, provided along the sheet transport path. Two jam detection sensors 81 may be provided at positions immediately upstream and downstream of the two heads 10 in the sheet transport path, respectively. Each jam detection sensor 81 may detect the tip of the transported sheet P and then outputs the detection signal to the jam detector 73 of the controller 1*p*. When the jam detector 73 does not receive the signal at a predetermined time interval depending on a relationship of the distance between the two sensors 81 with a transport speed of the sheet P, the jam detector 73 may determine that a sheet jam has occurred between the start of discharge of the pre-coating liquid to the sheet P and the passage of this sheet P through a region facing the head 10(K). In this case, the sheet jam may cause the pre-coating liquid to adhere to a side surface of the head 10(K). The jam detection sensor 81 positioned on the upstream side of the sheet transport path also may function as a sheet sensor, and a timing for the discharge of liquid droplets may be determined based on signals output from the sheet sensor, which may detect the tip of a sheet.

The jam counter 74 may count the number of times of sheet jams when the jam detector 73 detects a problematic sheet jam. When a jam purging procedure is performed, the jam counter 74 may reset the cumulative number of times of sheet jams to zero.

The passage counter 75 may count the number of sheets P which have passed below the head 10(K) after completion of the latest recovery operation. The number to be counted may be referred to as "sheet passage".

The application amount counter 76 may count the total amount of the pre-coating liquid applied, e.g., discharged, to the sheets P which have passed below the head 10(K) after completion of the latest recovery operation.

The elapsed time counter 77 may count time from detection of a sheet jam by the jam detector 73 to removal of a sheet P concerning the sheet jam from the sheet transport path. The elapsed time counter 77 may determine that the sheet P concerning the sheet jam has been removed from the sheet transport path when closing of a maintenance cover is detected after jam detection sensor 81 detects no sheet P.

When the jam detector 73 detects a sheet jam and then a sheet P concerning the sheet jam is removed from the sheet transport path, the elapsed time corrector 78 may correct elapsed time based on results of detection by a humidity detection sensor 82 provided in the vicinity of the heads 10 and the elapsed time measured by the elapsed time counter 77. If detected humidity is larger than reference humidity, the elapsed time corrector 78 may perform the correction such that the elapsed time may be decreased in proportion to an increase in a difference between the detected humidity and the reference humidity. If detected humidity is smaller than reference humidity, the elapsed time corrector 78 may perform the correction such that the elapsed time may be increased in proportion to an increase in a difference between the detected humidity and the reference humidity. The correction performed in this manner may enhance a correlation of an increase in the viscosity of a liquid adhering to the heads 10 with the elapsed time. The detected humidity may be the average of results of the humidity detection per unit time.

In particular, the correction of elapsed time may be performed as follows: six threshold values may be determined to define five humidity regions (0 to 20%, 21 to 40%, 41 to 60%, 61 to 80%, and 81 to 100%); if detected humidity is larger than humidity of a reference region to which reference humidity belongs, e.g., 21 to 40%, elapsed time may be corrected such that the elapsed time may be decreased in proportion to an increase in a difference in the humidity between the reference region and a detection region to which the detected humidity belongs; and if detected humidity is smaller than humidity of the reference region, elapsed time may be corrected such that the elapsed time may be increased in proportion to an increase in a difference in the humidity between the reference region and a detection region. Such correction of elapsed time based on the humidity regions may enable easy correction of elapsed time. Each humidity region may have the same humidity range, or at least two humidity regions may have different humidity ranges. The number of the humidity regions may be arbitrarily determined as long as at least two humidity regions are provided.

The jam count corrector 79 may perform correction to increase the number of times of sheet jams counted by the jam counter 74 every time the sheet passage counted by the passage counter 75 exceeds a predetermined threshold value, e.g., first threshold value: 100 sheets in the present embodiment. Furthermore, the jam count corrector 79 may perform correction to increase the number of times of sheet jams counted by the jam counter 74 every time the total application amount of ink counted by the application amount counter 76 exceeds a predetermined threshold value, e.g., third threshold value: 100 ml.

The maintenance control unit 72 may be configured to control the holder lift motor 68, the heads 10 via the head control unit 71, the purge pump 69, the wiper moving motor 63, the lip lift motor 44, the pump 53 of the humidifying mechanism 50, and the reversal mechanism 7 to carry out the flushing process, purging process, wiping process, and humidifying process included in the maintenance operation.

The flushing process may be performed immediately before the start of printing and at a regular time interval after the start of the printing. In the flushing process, the actuator units 17 of the heads 10 may be driven by the maintenance control unit 72 to force liquid droplets to be discharged from the discharge ports 14*a*. The liquid droplets may be discharged onto the glass table 8 or the sheet P during a printing process. In the latter case, the liquid droplets may be discharged in the minimum amount, e.g., 4 pl, so as to avoid image pixels in view of the quality of an image.

The purging process may be performed after a sheet P, which has caused a sheet jam, is removed from the sheet transport path or immediately before the start of printing. At the start of the purging process, the holder lift motor 68 may be controlled by the maintenance control unit 72 to move the heads 10 to a safe position, and then the reversal mechanism 7 may be controlled by the maintenance control unit 72 to introduce the glass table 8 to a position facing the discharge surfaces 10*a*. The purge pump 69 may subsequently be controlled by the maintenance control unit 72 to pump a liquid, e.g., ink or pre-coating liquid, to the heads 10. The liquid may be forced to be discharged from the discharge ports 14*a*. The waste liquid may be retrieved to a waste fluid tank via the glass table 8.

Figure 10A:
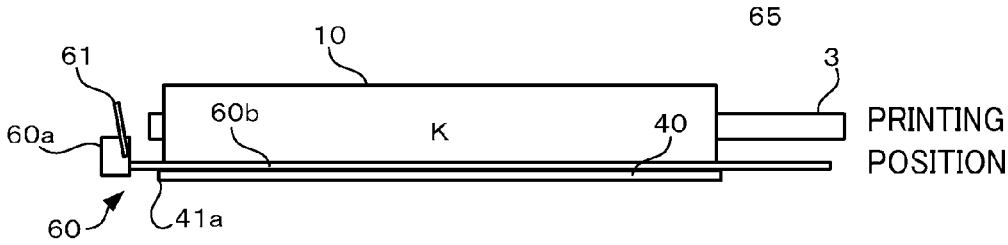
FIG. 10A is a drawing illustrating a wiping process of a printer according to an embodiment of the present invention.
Figure 10B:
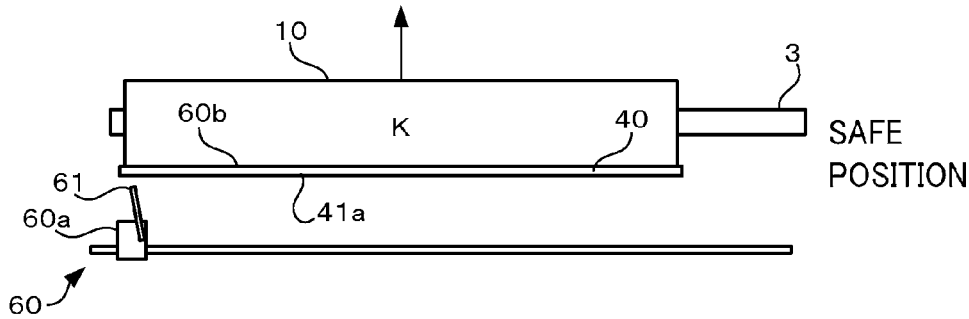
FIG. 10B is another drawing illustrating the wiping process according to an embodiment of the present invention.
Figure 10C:
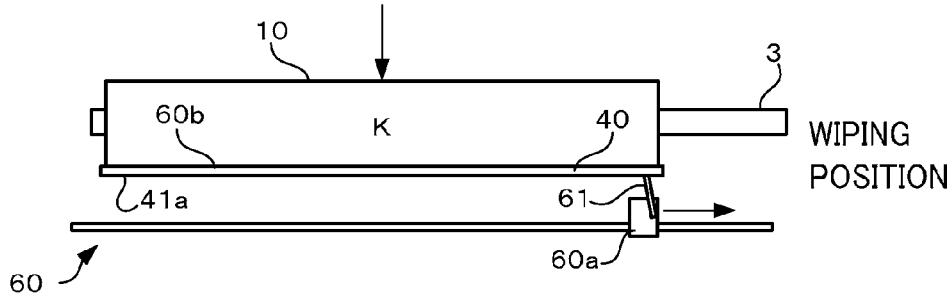
FIG. 10C is still another drawing illustrating the wiping process according to an embodiment of the present invention.

The wiping process may be performed after the flushing process or the purging process. As illustrated in FIG. 10A, each head 10 may be located at a printing position immediately before the wiping process. On an instruction for the wiping process, the holder lift motor 68 may be controlled by the maintenance control unit 72 to move the head 10 to the safe position, as illustrated in FIG. 10B, and the lip lift motor 44 may be controlled by the maintenance control unit 72 to guide the protruding part 41*a* to the separation position. In this state, the wiper moving mechanism 60 may be driven, and the wiper 61 may move to a position immediately upstream of the discharge surface 10*a* right below the protruding part 41*a*. Then, the maintenance control unit 72 may move the head 10 down to a wiping position, as illustrated in FIG. 10C. The wiper moving mechanism 60 may be driven to move the wiper 61 while the wiper 61 may contact the discharge surface 10*a*. The wiper 61 may be moved in a direction from the stand-by position on the left side to the right side, as illustrated in FIG. 8B. The maintenance control unit 72 may operate to temporarily place the head 10 at the safe position after the discharge surface 10*a* has been wiped and then may return the head 10 to the printing position after the wiper 61 has been moved to the stand-by position, thereby completing the wiping process.

Figure 11A:
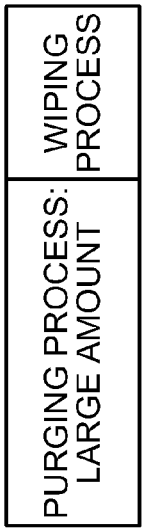
FIG. 11A is a drawing illustrating a maintenance operation in the occurrence of a jam according to an embodiment of the present invention.
Figure 11B:
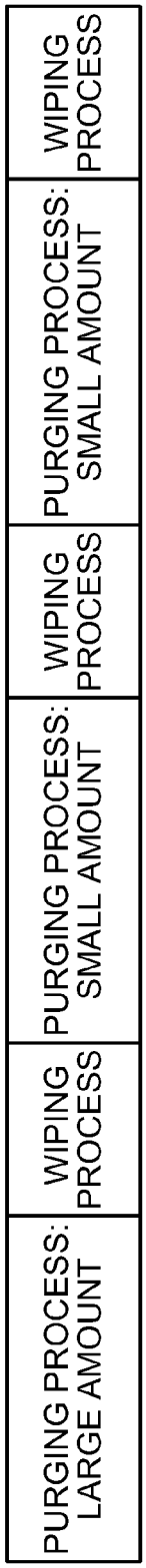
FIG. 11B is a drawing illustrating another maintenance operation in the occurrence of a jam according to an embodiment of the present invention.

When the sheet transport path is jammed with the sheet P, e.g., when the jam detector 73 detects a sheet jam caused by the sheet P, the maintenance control unit 72 may perform a recovery operation including a sequence of the purging process and wiping process after the sheet P is removed by users. A combination and frequencies of the purging process and wiping process in the recovery operation may be determined, as illustrated in FIGS. 11A and 11B. FIG. 11A depicts a normal purging procedure in which the purging process and the wiping process are each carried out once. FIG. 11B depicts a jam purging procedure, and a combination of the purging process and the wiping process may be repeated three times.

After removal of a sheet which has caused a sheet jam, the normal purging procedure may generally be employed as the recovery operation. In the purging process, a liquid of approximately 2 ml may be forced to be discharged from all discharge ports 14*a*. The jam purging procedure may be performed when a jam count corrected by the jam count corrector 79 reaches a predetermined threshold value, e.g., second threshold value: three times; two combinations of the purging process and the wiping process may be performed in addition to the normal purging procedure. In the second and third purging processes, an amount of a liquid to be discharged may be smaller than that in the first purging process, e.g., approximately 1 ml. Furthermore, in proportion to the decrease in the amount of the liquid forced to be discharged, the speed of the wiping by the wiper 61, e.g., movement speed of the wiper 61, may be decreased in the second and third wiping processes relative to that in the first wiping process. An increase in the frequency of the purging process may correspond to a decrease in the speed of wiping.

When a jam count corrected by the jam count corrector 79 reaches three, the frequencies of the purging process and wiping process may be increased in the recovery operation as compared with the other case.

When the elapsed time corrected by the elapsed time corrector 78 is less than a predetermined threshold value, e.g., fourth threshold value: four hours, the maintenance control unit 72 may perform the recovery operation without the humidifying process; when the elapsed time corrected by the elapsed time corrector 78 is not less than four hours, the maintenance control unit 72 may perform the recovery operation after the humidifying process.

If the sheet P, to which the pre-coating liquid has been applied, causes a sheet jam before the sheet P completely passes across the head 10(K), the pre-coating liquid may adhere to the upstream-side surface of the head 10(K). If the sheet jam occurs several times, accumulation of an adhering pre-coating liquid and spread of such a pre-coating liquid to the discharge surface 10*a* may cause defective discharge. The jam purging procedure may be performed once every three times of removal of sheets, which have caused sheet jams. Thus, problems caused by the spread of the pre-coating liquid may be prevented.

The humidifying process may include humidification of the discharge space S1 being in a capped state, e.g., sealed state, and may start after completion of printing or removal of a sheet which has caused a sheet jam. During the humidifying process, the heads 10 may be located at the printing position. In addition, the glass table 8 may be positioned so as to face the discharge surfaces 10*a* by the reversal mechanism 7.

At the beginning of the humidifying process, the maintenance control unit 72 may move the movable portion 42 down with the rotation of the gears 43. Then, the protruding part 41*a* may be moved from the separation position for printing, e.g., FIG. 6, to the contact position, e.g., FIG. 5. The protruding part 41*a* may be brought into contact with the glass table 8 to seal the discharge space S1. Even in the stand-by state or resting state other than printing, the protruding part 41*a* may be moved to the contact position by the maintenance control unit 72 to provide the capped state.

The pump 53 may be driven by the maintenance control unit 72 to circulate the humidified air. Once the pump 53 is driven, air may be retrieved from the opening 51*a*, and humidified air may be supplied from the opening 51*b* to the discharge space S1. The retrieved air may travel to the lower space inside the tank 54 through the tubes 55 and 56. The retrieved air may be humidified with water stored in the lower space and then held in the upper space of the tank 54. The humidified air held in the upper space may have a humidity of approximately 100%. The humidified air in the upper space may be output to the opening 51*b* through the tube 57. The pump 53 may be stopped by the maintenance control unit 72 in a predetermined time period. The humidified air may be supplied to humidify ink inside the caps 40, which may prevent an increase in the viscosity of ink in the discharge ports 14*a*. Furthermore, agglomerate generated on the discharge surfaces 10*a* may also be humidified, which may enable easy removal thereof through the wiping process.

In FIG. 5, black arrows may indicate the flow of non-humidified air, and white arrows may indicate the flow of humidified air. A switching valve provided to each branched portion 55*b* and 57*b*, as illustrated in FIG. 7, may be controlled by the maintenance control unit 72 in conjunction with the driving of the pump 53 to selectively adjust the airflow at each branched portion 55*b* and 57*b*.

Figure 12:
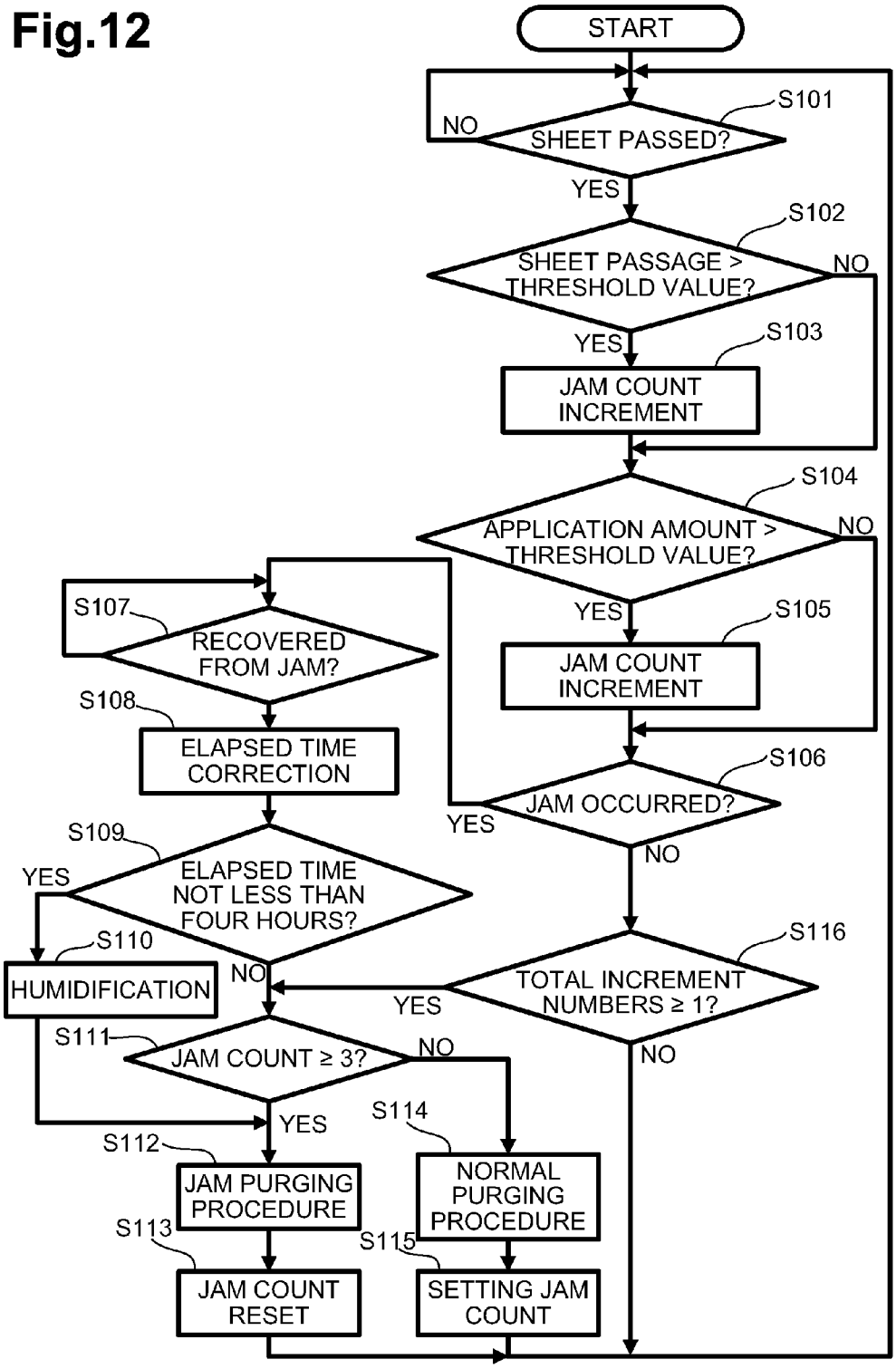
FIG. 12 is a flowchart illustrating a maintenance operation during a transport of a sheet according to an embodiment of the present invention.

Referring to FIG. 12, when the sheet P passes below the head 10(K), e.g., YES at S101, the passage counter 75 may count the sheet passage, and the application amount counter 76 may count the total amount of the pre-coating liquid applied to the sheet P. When the sheet passage exceeds a threshold value, e.g., a first threshold value, e.g., YES at S102, the jam count corrector 79 may increase a jam count by the unit number of times, e.g., one, at S103. Then, when the total amount of the applied ink exceeds a threshold value, e.g., YES at S104, the jam count corrector 79 may increase the jam count by the unit number of times at S105.

The jam detector 73 may determine whether the sheet P has caused a sheet jam at S106. When the jam detector 73 determines that a sheet jam occurs, e.g., YES at S106, the maintenance control unit 72 may wait until the sheet P which has caused the sheet jam is removed by users, e.g., NO at S107, after the jam counter 74 increases the jam count by one. The elapsed time counter 77 may start to count elapsed time from detection of the sheet jam. The elapsed time may continued to be counted until removal of the sheet concerning the sheet jam. During this step, the elapsed time corrector 78 may sample an output from the humidity detection sensor 82 for every unit time and calculate average humidity, e.g., detected humidity. After removal of the sheet which has caused the sheet jam, e.g., YES at S107, when the detected humidity is larger than reference humidity, the elapsed time corrector 78 may perform correction such that the elapsed time may be decreased in proportion to an increase in a difference between the detected humidity and the reference humidity; or when the detected humidity is less than the reference humidity, the elapsed time corrector 78 may perform the correction such that the elapsed time may be increased in proportion to an increase in a difference between the detected humidity and the reference humidity at S108. Then, the maintenance control unit 72 may determine whether the elapsed time is greater than or equal to four hours at S109.

When the maintenance control unit 72 determines that the elapsed time is greater than or equal to four hours, e.g., YES at S109, the humidifying process may be performed at S110, and then the jam purging procedure, as illustrated in FIG. 11B, may be performed at S112. When the maintenance control unit 72 determines that the elapsed time is less than four hours, e.g., NO at S109, the maintenance control units 72 may determine whether the jam count is greater than or equal to three, e.g., a second threshold value, at S111. When the jam count is less than three, e.g., NO at S111, the maintenance control unit 72 may perform the normal purging procedure, as illustrated in FIG. 11A, at S114. The jam counter 74 subsequently may convert the jam count into the total jam count at S115, and then the procedure may return to S101. The term "the total jam count" may refer to the sum total of increased numbers introduced from the sheet passage and the application amount of ink and the jam count immediately before the normal purging procedure. When the jam count is greater than or equal to three, e.g., YES at S111, the maintenance control unit 72 may perform the jam purging procedure at S112. The jam counter 74 subsequently may reset the jam count to zero at S113, and then the procedure may return to S101.

When the jam detector 73 determines that the sheet P does not cause a sheet jam, e.g., NO at S106, the maintenance control unit 72 may determine whether a jam count has been corrected to an extent exceeding the unit number of times depending on the passage of sheet P and the amount of ink applied to the sheet P at S116. When the degree of the correction, e.g., total increased number, is greater than or equal to the unit number of times, e.g., one, the procedure may go to S111; and when the degree of the correction is less than the unit number of times, the procedure may return to S101. After S111 and S101, the procedure may advance as described above.

In the printer 1, the recovery operation may be performed in view of both direct adhesion of the pre-coating liquid to the discharge surface 10*a* of the head 10(K) due to sheet jams and accumulation of the pre-coating liquid on a side surface of the head 10(K) due to the passage of the sheet P. This may enable efficient elimination of a reaction of the pre-coating liquid with ink in the vicinity of the discharge ports 14*a*, so that a decrease in discharge properties due to such a reaction may be efficiently prevented.

When a jam count corrected by the jam count corrector 79 is greater than or equal to three, the jam purging procedure may be performed in the recovery operation; thus, the frequencies of the purging process and wiping process to be carried out may be greater than those in the normal purging procedure, which may enable further steady removal of the pre-coating liquid remaining on the head 10(P) and products derived from the pre-coating liquid.

In the jam purging procedure, the amount of liquid to be discharged from all discharge ports 14*a* may be gradually decreased as the sequence of the purging processes advances, which may prevent an increase in the amount of the liquid used in the purging process. In addition, the discharge surfaces 10*a* may be wet due to the purging process before the wiping process, which may prevent damage of the discharge surfaces 10*a* through the wiping process.

In the second and third wiping processes in the jam purging procedure, the wiper 61 may move at a speed less than that in the first wiping process, so that the discharge surfaces 10*a* may be efficiently wiped while damage of the discharge surfaces 10*a* may be prevented.

Because a jam count is corrected based on the total application amount of the pre-coating liquid, the recovery operation may be performed at an appropriate moment depending on the frequency of discharge of the pre-coating liquid.

When elapsed time corrected by the elapsed time corrector 78 is less than four hours, only the recovery operation may be performed without the humidifying process; and when the elapsed time corrected by the elapsed time corrector 78 is greater than or equal to four hours, the recovery operation may be performed after the humidifying process. Because the elapsed time corrector 78 corrects elapsed time based on detected humidity, the recovery operation may be adequately performed depending on the elapsed time from the occurrence of a sheet jam.

In this case, the average results of the humidity detection may be employed as the detected humidity, which may enable easy control for the correction of elapsed time.

Each cap 40 may cover the discharge surface 10*a* and part of a side surface of the head 10, so that the pre-coating liquid remaining on a side surface of the head 10(K) may be prevented from drying and then adhering thereto.

In this case, the humidifying process may steadily prevent the pre-coating liquid remaining on a side surface of the head 10(K) from drying and then adhering thereto.

The upper surface of the wiper 61 may be tilted such that an end on the upstream side in the sheet transport direction may have the greater height in a direction orthogonal to the discharge surface 10*a* during the wiping process. The pre-coating liquid on a passing sheet P may likely accumulate on the upstream side surface of the head 10(K); thus, the pre-coating liquid spreading to the discharge surface 10*a* may be efficiently removed.

Figure 13:
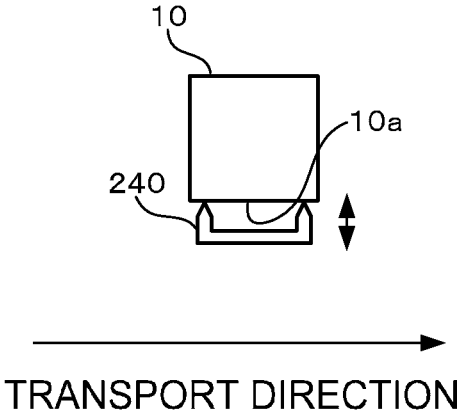
FIG. 13 is a cross-sectional view illustrating a capping mechanism according to another embodiment of the present invention.

Each cap 40 may cover the entire discharge surface 10*a* of the corresponding one of the heads 10. In another embodiment, as shown in FIG. 13, each cap 240 may have a bottom plate provided aside from each head 10 and an elastic annular protrusion projecting from the bottom plate. The cap 240 may be shifted by the cap moving mechanism between a contact position at which the tip of the annular protrusion contacts the discharge surface 10*a* and a separation position at which the tip of the annular protrusion is away from the discharge surface 10*a*. The cap 240 being at the contact position may cover the discharge surface 10*a* in a region in which the discharge ports 14*a* are formed. In this case, the peripheries of the discharge surface 10*a* may be exposed to the exterior of the cap 240.

In addition to accumulation of the pre-coating liquid on a side surface of the head 10(K) due to sheet jams and sheet passage, ink transferred through the wiping process in each purging procedure may accumulate on the side surface of the head 10(K). In this case, an increase in the viscosity of the ink and drying of a product generated by a reaction of the ink with the pre-coating liquid may quickly advance. Agglomerate generated on the side surface due to sheet jams may be therefore less likely to spread onto the discharge surface 100*a*. For example, S111 in FIG. 12 may include determining whether a jam count is greater than or equal to five. Especially in a highly humid environment, unsatisfactory drying may cause highly adhesive substances with high viscosity to adhere onto the discharge surface 10*a*. A maintenance control unit of the present embodiment may control the jam purging procedure such that ink is discharged in a larger amount in proportion to an increase in humidity detected by the humidity detection sensor 82.

In a structure for the humidifying process, an inlet and outlet of humidified air may be provided to the cap 240 or may be provide to the head 10.

The recovery operation may be performed in view of both the amount of the pre-coating liquid adhering to a side surface of the head 10(K) due to sheet jams and the amount of the pre-coating liquid adhering to the head 10(K) due to the passage of the sheet P; thus, the pre-coating liquid may be efficiently prevented from transferring to the vicinity of the discharge ports 14*a* by, for instance, a sheet jam caused later.

Because the cap 240 covers a part of the discharge surface 10*a*, a size of the capping mechanism may be reduced.

Figure 14:
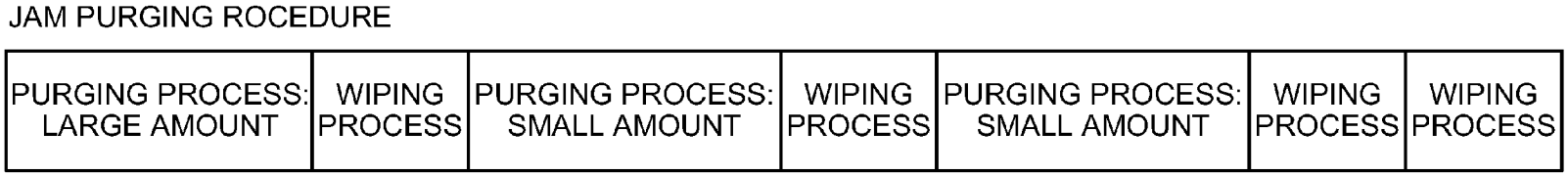
FIG. 14 is a drawing illustrating a jam purging procedure according to an embodiment of the present invention.

In the jam purging procedure of the recovery operation, the purging process and the wiping process may be performed in the same number of times. In another embodiment, the number of times of the wiping process may be greater than that of the purging process. As illustrated in FIG. 14, three combinations of the purging process and the wiping process may be followed by an additional wiping process. The wiping speed may be lowest in the final wiping process. This configuration may enable efficient removal of agglomerate and precipitate adhering to the discharge surfaces 10*a*.

The jam purging procedure may be performed when a jam count reaches three. In another embodiment, the jam purging procedure may be performed in response to another jam count. The jam count may be reset to zero every time after the jam purging procedure. In another embodiment, the jam count may not be reset to zero. In this case, multiple threshold values may be defined to determine whether the jam purging procedure should be carried out. In such multiple threshold values, the minimum value may be at least two, and a difference between one threshold value and the next threshold value may be at least two.

A combination of the purging process and the wiping process may be performed several times. In another embodiment, at least part of the second and subsequent purging processes may not be performed in the jam purging procedure.

A discharge amount of a liquid may be gradually decreased as the sequence of purging processes advances. In another embodiment, the liquid may be discharged in an arbitrary amount in the purging processes of the jam purging procedure. The amount of a liquid may be sequentially increased as the sequence of purging processes advances.

The moving speed of the wiper 61 in the second and third wiping processes may be less than that in the first wiping process. In another embodiment, the wiper 61 may move at various speeds in each wiping process in the jam purging procedure. The moving speed of the wiper 61 may be kept at a certain level as the sequence of wiping processes advances.

The average of results of humidity detection may be employed as the detected humidity. In another embodiment, the result of humidity detection immediately after removal of a sheet which has caused a sheet jam may be directly employed.

The upper surface of the wiper 61 may be tilted such that an end on the upstream side in the sheet transport direction has a greater height in a direction orthogonal to the discharge surface 10*a* during the wiping process. In another embodiment, the upper surface of the wiper may be, for instance, parallel to the discharge surfaces 10*a*.

The printer 1 of the first embodiment may have the two heads 10. In another embodiment, the printer may have three or more heads 10.

The head 10 which discharges the pre-coating liquid may be positioned on the most upstream side in the sheet transfer direction. In another embodiment, the head 10 disposed at such a position may discharge ink droplets, or the pre-coating liquid may be applied with, for instance, a roller.

While the invention has been described in connection with various exemplary structures and illustrative embodiments, it will be understood by those skilled in the art that other variations and modifications of the structures, configurations, and embodiments disclosed above may be made without departing from the scope of the invention. For example, this application comprises possible combinations of the various elements and features disclosed herein, and the particular elements and features presented in the claims and disclosed above may be combined with each other in other ways within the scope of the application, such that the application should be recognized as also directed to other embodiments comprising other possible combinations. Other structures, configurations, and embodiments consistent with the scope of the claimed invention will be apparent to those skilled in the art from a consideration of the specification or practice of the invention disclosed herein. It is intended that the specification and the described examples are illustrative with the true scope of the invention being defined by the following claims.

What is claimed is:

1. An image recording apparatus comprising:

a liquid applying mechanism configured to apply a first liquid onto a recording medium;

a liquid discharge head comprising a liquid discharge surface and configured to discharge a second liquid from a liquid discharge port formed in the liquid discharge surface onto the recording medium, wherein the liquid discharge head is disposed downstream from the liquid applying mechanism in a transport direction of the recording medium;

a wiper configured to wipe the liquid discharge surface of the liquid discharge head;

a recording medium sensor disposed downstream from the liquid discharged head in the transport direction and configured to detect a presence of the recording medium;

a processor; and a computer readable medium storing computer readable instructions, when executed by the processor, cause the image recording apparatus to perform:

determining a jam of a recording medium onto which the first liquid has been applied by the liquid applying mechanism based on a detection of the recording medium sensor;

counting a number of jams determined;

determining a passage of a recording medium through a region facing the liquid discharge head;

counting a number of passages determined;

incrementing the number of jams when the number of passages is equal to or greater than a first threshold value; and performing a head recovery operation in which the liquid discharge head discharges the second liquid through the liquid discharge port and the wiper wipes the discharge surface when a jam of a recording medium is determined and when the number of jams is incremented.

2. The image recording apparatus according to claim 1, wherein the computer readable instructions, when executed by the processor, cause the image recording apparatus to further perform:

a further head recovery operation, in which one of a volume of the second liquid ejected by the liquid discharge head and a number of wipings performed by the wiper is greater than that of the head recovery operation, when the number of jams is equal to or greater than a second threshold value.

3. The image recording apparatus according to claim 1, wherein the head recovery operation comprises a first discharge operation and a second discharge operation performed after the first discharge operation, wherein an amount of the second liquid discharged in the first discharge operation is greater than an amount of the second liquid discharged in the second discharge operation.

4. The image recording apparatus according to claim 1, wherein the head recovery operation comprises a first wiping operation and a second wiping operation performed after the first wiping operation, wherein a speed of the first wiping operation is greater than a speed of the second wiping operation.

5. The image recording apparatus according to claim 1, wherein the computer readable instructions, when executed by the processor, cause the image recording apparatus to further perform:

resetting the number of times of the jams when the number of times of the jams is greater than or equal to the second threshold value and after the head recovery operation is performed.

6. The image recording apparatus according to claim 1, wherein the computer readable instructions, when executed by the processor, cause the image recording apparatus to further perform:

counting an amount of the first liquid applied to recording media which have passed through a region facing the liquid discharge head; and incrementing the number of jams when the amount of the first liquid applied to the recording media is equal to or greater than a third threshold value.

7. The image recording apparatus according to claim 1 further comprising:

a wiper moving mechanism configured to move the wiper along the liquid discharge surface in a direction orthogonal to the transport direction of the recording medium, wherein a height of the wiper in a direction orthogonal to the liquid discharge surface is greater at an upstream end of the liquid discharge surface in the transport direction than at a downstream end of the liquid discharge surface in the transport direction.

8. The image recording apparatus according to claim 1, wherein the first liquid is configured to agglomerate or precipitate a component of the second liquid.

9. The image recording apparatus according to claim 1, wherein the computer readable instructions, when executed by the processor, cause the image recording apparatus to further perform:

resetting the number of passages when the number of passages is greater than or equal to the first threshold value.

10. The image recording apparatus according to claim 7, wherein the computer readable instructions, when executed by the processor, cause the image recording apparatus to further perform:

resetting the amount of the first liquid applied to the recording media when the amount of the first liquid applied to the recording media is greater than or equal to the third threshold value.

11. The image recording apparatus according to claim 1 further comprising:

a purging pump configured to pressurize the second liquid in the liquid discharge head, wherein the liquid discharge head is configured to discharge the second liquid from the liquid discharge port by pressurizing of the purging pump.

* * * * *